US010087958B2

(12) United States Patent
McKernan et al.

(10) Patent No.: US 10,087,958 B2
(45) Date of Patent: Oct. 2, 2018

(54) FLUID POWER CONTROL SYSTEM FOR MOBILE LOAD HANDLING EQUIPMENT

(75) Inventors: Pat S. McKernan, Portland, OR (US); Gregory A. Nagle, Portland, OR (US)

(73) Assignee: Cascade Corporation, Portland, OR (US)

( * ) Notice: Subject to any disclaimer, the term of this patent is extended or adjusted under 35 U.S.C. 154(b) by 1808 days.

(21) Appl. No.: 13/451,320

(22) Filed: Apr. 19, 2012

(65) Prior Publication Data

US 2013/0277584 A1 Oct. 24, 2013

(51) Int. Cl.

| | |
|---|---|
| ***F15B 11/22*** | (2006.01) |
| ***B66F 9/22*** | (2006.01) |
| *F15B 15/28* | (2006.01) |

(52) U.S. Cl.

CPC ..... *F15B 11/22* (2013.01); *B66F 9/22* (2013.01); *F15B 15/2846* (2013.01); *F15B 2211/3059* (2013.01); *F15B 2211/30585* (2013.01); *F15B 2211/315* (2013.01); *F15B 2211/327* (2013.01); *F15B 2211/40515* (2013.01); *F15B 2211/413* (2013.01); *F15B 2211/41527* (2013.01); *F15B 2211/41536* (2013.01); *F15B 2211/426* (2013.01); *F15B 2211/427* (2013.01);

(Continued)

(58) Field of Classification Search

CPC ..... F15B 11/22; F15B 2211/782; F15B 2211/40515

USPC ..... 91/171, 515, 532

See application file for complete search history.

(56) References Cited

U.S. PATENT DOCUMENTS

| | | | |
|---|---|---|---|
| 2,201,189 | A | 5/1940 | Makaroff et al. |
| 2,891,765 | A | 6/1959 | Pearne |

(Continued)

FOREIGN PATENT DOCUMENTS

| | | | |
|---|---|---|---|
| CN | 101672311 | A | 3/2010 |
| CN | 101713190 | A | 5/2010 |

(Continued)

OTHER PUBLICATIONS

International Search Report and Written Opinion, PCT International App. No. PCT/US2013/025052, dated Apr. 8, 2013, 12 pgs.

(Continued)

*Primary Examiner* — Michael Leslie
*Assistant Examiner* — Abiy Teka
(74) *Attorney, Agent, or Firm* — Chernoff, Vilhauer, McClung & Stenzel, LLP

(57) ABSTRACT

A fluid power control system for load handling mobile equipment includes a pair of hydraulic actuators for moving respective cooperating load-engaging members selectively toward or away from each other, or in a common direction, at respective asynchronous speeds to selectively attain either synchronous or asynchronous respective positions of the actuators. The actuators have sensors enabling a controller to monitor their respective movements and correct unintended differences in the actuators' respective movements, such as unintended differences in relative intended positions, speeds, or rates of change of speeds. Respective hydraulic valves responsive to the controller separately and nonsimultaneously decrease respective flows through the respective actuators to more accurately and rapidly correct differences from the intended relative movements of the actuators.

14 Claims, 3 Drawing Sheets

(52) U.S. Cl.
CPC ..... *F15B 2211/50518* (2013.01); *F15B 2211/5153* (2013.01); *F15B 2211/526* (2013.01); *F15B 2211/527* (2013.01); *F15B 2211/6336* (2013.01); *F15B 2211/6654* (2013.01); *F15B 2211/6656* (2013.01); *F15B 2211/7053* (2013.01); *F15B 2211/7128* (2013.01); *F15B 2211/75* (2013.01); *F15B 2211/755* (2013.01); *F15B 2211/782* (2013.01)

(56) References Cited

U.S. PATENT DOCUMENTS

| | | | | |
|---|---|---|---|---|
| 2,942,848 | A | | 6/1960 | Friesen |
| 2,984,072 | A | | 5/1961 | Born |
| 3,178,156 | A | | 4/1965 | Rigers |
| 3,179,274 | A | | 4/1965 | Comfort |
| 3,265,357 | A | | 8/1966 | Schilling |
| 3,289,868 | A | | 12/1966 | Miller et al. |
| 3,317,004 | A | | 5/1967 | Harrison |
| 3,377,924 | A | | 4/1968 | Spencer |
| 3,556,480 | A | | 1/1971 | Johansson |
| 3,625,115 | A | | 12/1971 | Tani |
| 3,638,535 | A | | 2/1972 | Pointer |
| 3,648,565 | A | * | 3/1972 | Probst et al. ..... 91/171 |
| 3,750,899 | A | | 8/1973 | Greer |
| 3,757,899 | A | | 9/1973 | Smith, Jr. |
| 3,769,881 | A | | 11/1973 | Aoki |
| 3,967,701 | A | | 7/1976 | Hegenbart |
| 3,968,730 | A | | 7/1976 | Lionet |
| 3,990,594 | A | | 11/1976 | Olson et al. |
| 4,050,673 | A | | 9/1977 | Nishimura |
| 4,230,304 | A | | 10/1980 | Tol |
| 4,241,581 | A | | 12/1980 | Chace |
| 4,241,901 | A | | 12/1980 | Shircliffe |
| 4,251,974 | A | | 2/1981 | Vanderklaauw |
| 4,369,625 | A | | 1/1983 | Izumi et al. |
| 4,671,166 | A | | 6/1987 | Glaze et al. |
| 4,679,489 | A | | 7/1987 | Jasinski et al. |
| 4,682,931 | A | | 7/1987 | House |
| 4,706,458 | A | | 11/1987 | Corghi |
| 4,714,399 | A | | 12/1987 | Olson |
| 4,777,798 | A | | 10/1988 | Jacobson et al. |
| 4,815,712 | A | | 3/1989 | Kawada |
| 4,848,732 | A | | 7/1989 | Rossato |
| 5,012,898 | A | | 5/1991 | Tsymberov |
| 5,024,141 | A | | 6/1991 | Kawada |
| 5,050,844 | A | | 9/1991 | Hawk |
| 5,065,844 | A | | 11/1991 | Hon |
| 5,096,159 | A | | 3/1992 | Fletcher |
| 5,144,801 | A | | 9/1992 | Scanderbeg et al. |
| 5,199,686 | A | | 4/1993 | Fletcher |
| 5,299,658 | A | | 4/1994 | Cox et al. |
| 5,597,987 | A | | 1/1997 | Gilliland et al. |
| 5,740,886 | A | | 4/1998 | Fletcher |
| 5,860,491 | A | | 1/1999 | Fletcher |
| 5,927,932 | A | | 7/1999 | Seaberg |
| 6,135,704 | A | | 10/2000 | Seaberg |
| 6,186,280 | B1 | | 2/2001 | Healy |
| 6,189,432 | B1 | * | 2/2001 | Colarelli et al. ..... 91/171 |
| 6,256,566 | B1 | | 7/2001 | Kamiya et al. |
| 6,321,634 | B1 | | 11/2001 | Yeo et al. |
| 6,454,511 | B1 | | 9/2002 | Jordan et al. |
| 6,691,605 | B2 | | 2/2004 | Rollgardh |
| 6,789,458 | B2 | * | 9/2004 | Schumacher et al. ..... 91/363 R |
| 6,834,574 | B2 | | 12/2004 | Neumann |
| 6,964,322 | B2 | | 11/2005 | Green et al. |
| 7,047,865 | B2 | | 5/2006 | Neumann |
| 7,121,457 | B2 | | 10/2006 | Michal, III |
| 7,552,671 | B2 | | 6/2009 | Neumann |
| 2003/0233184 | A1 | | 12/2003 | Roncari |
| 2005/0102081 | A1 | | 5/2005 | Patterson |
| 2009/0094971 | A1 | | 4/2009 | Dantas et al. |
| 2009/0281655 | A1 | | 11/2009 | McKernan et al. |

FOREIGN PATENT DOCUMENTS

| | | | |
|---|---|---|---|
| CN | 101828043 | A | 9/2010 |
| CN | 102021899 | A | 4/2011 |
| CN | 102441589 | A | 5/2012 |
| DE | 3433136 | | 9/1984 |
| EP | 0386569 | A1 | 9/1990 |
| EP | 0724541 | B1 | 2/1999 |
| JP | 03166199 | | 7/1991 |
| JP | 6-159323 | A | 6/1994 |
| WO | 95-11189 | A1 | 4/1995 |
| WO | WO 95/11189 | | 4/1995 |
| WO | 2009036562 | A2 | 3/2009 |
| WO | 2010134110 | A1 | 11/2010 |

OTHER PUBLICATIONS

European Search Report, dated Dec. 23, 2015, European Patent App. No. 13778907.9, Cascade Corporation, 5 pgs.

* cited by examiner

FLUID POWER CONTROL SYSTEM FOR MOBILE LOAD HANDLING EQUIPMENT

BACKGROUND OF THE INVENTION

This invention relates to improvements in fluid power control systems for hydraulically actuated, cooperating multiple load-engaging members normally mounted on lift trucks or other industrial vehicles. The multiple load-engaging members may be load-handling forks, clamp arms for load surfaces of curved, planar or other configurations, split clamp arms for handling multiple loads of different sizes simultaneously, layer picker clamp arms and their supporting booms, upenders, or other multiple load-engaging members movable cooperatively, but often differently, by linear or rotary hydraulic actuators. Differences in the respective cooperative movements of the respective multiple load-engaging members may include one or more differences in position, speed, acceleration, deceleration, and/or other variables. Although such differences are sometimes intended, they usually are unintended and cause the cooperating load-engaging members to become uncoordinated.

The respective movements of such cooperating mobile load-engaging members have conventionally been controlled either manually or automatically by fluid power valve assemblies which regulate respective flows of hydraulic fluid through parallel connections to separate hydraulic actuators which move each load-engaging member. Hydraulic flow divider/combiner valves are commonly used to try to achieve coordinated synchronous movements of such parallel-connected hydraulic actuators by attempting automatically to apportion respective hydraulic flows to and from the separate hydraulic actuators involved. However, such flow divider/combiner valves are capable of controlling only roughly approximate movements of separate hydraulic actuators, with the result that their presence in any hydraulic control system prevents highly accurate control of the actuators and allows accumulated errors. Other prior systems, which attempt to automatically correct unintended differences in the respective simultaneous movements of separate hydraulic actuators by monitoring their respective positions to provide feedback to respective hydraulic control valves, either variably regulate the separate control valves simultaneously, or completely block one of the valves until the correction has been completed, thereby substantially limiting the speed with which the actuators are able to complete their intended movements.

DETAILED DESCRIPTION OF PREFERRED EMBODIMENTS

Figure 1:
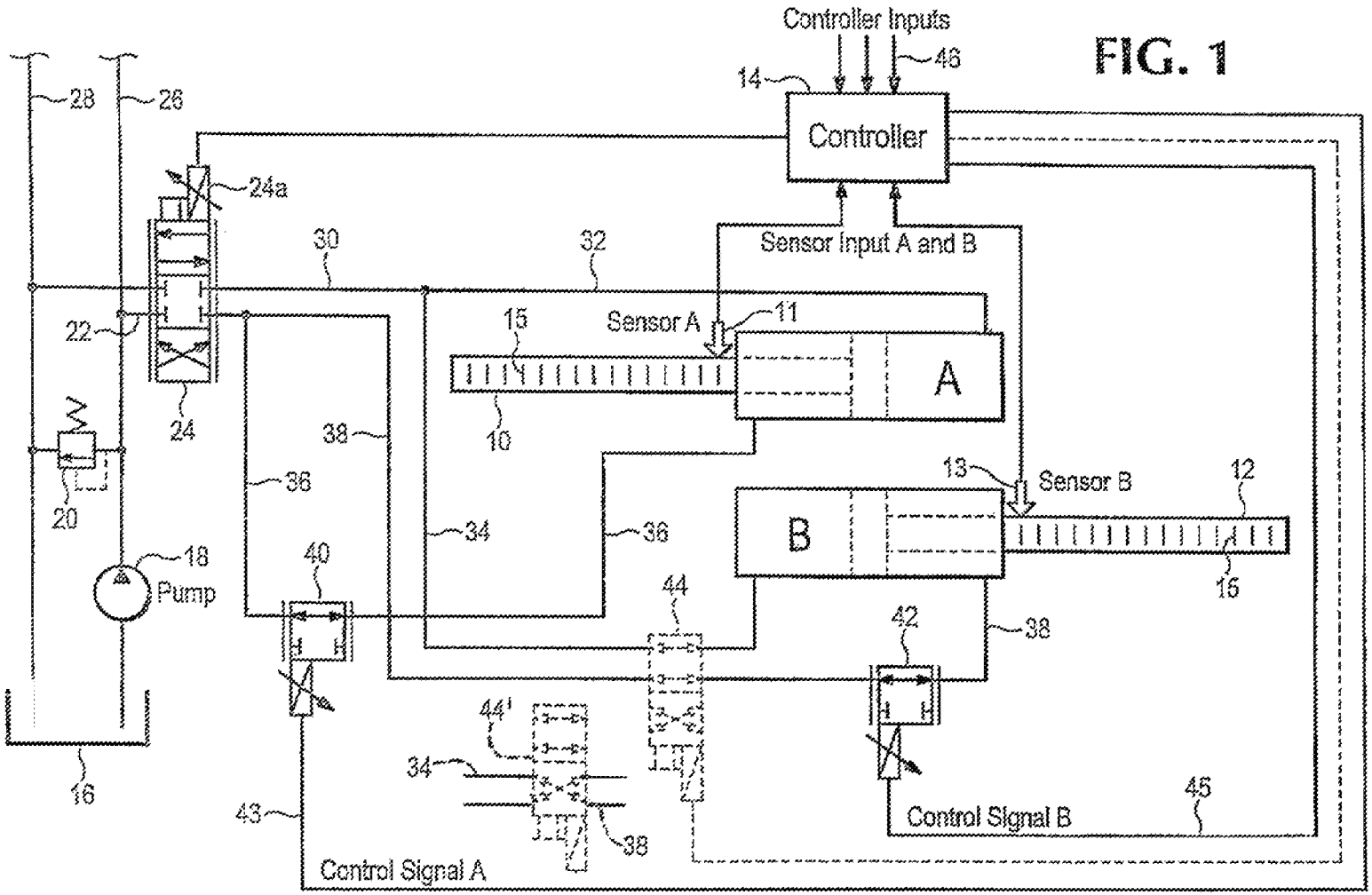
FIG. 1 is a simplified electro-hydraulic diagram of an exemplary fluid power control system usable in this invention.

FIG. 1 shows a pair of exemplary linear hydraulic actuators in the form of separate, laterally-extending, oppositely-facing hydraulic piston and cylinder assemblies A and B. In general, oppositely-facing piston and cylinder assemblies are extremely common arrangements on lift truck load-handling carriages. Alternatively, the hydraulic actuators A and B could be of a rotary hydraulic motor type, depending upon the load-handling application.

An exemplary type of piston and cylinder assembly suitable for actuators A and B in the present disclosure is a Parker-Hannifin piston and cylinder assembly as shown in U.S. Pat. No. 6,834,574, the disclosure of which is hereby incorporated by reference in its entirety. Such piston and cylinder assembly includes an optical sensor, such as sensor 11 or sensor 13 in FIG. 1, capable of reading finely graduated unique incremental position indicia, indicated schematically as 15, along the lengths of each respective piston rod 10 or 12. As explained in the foregoing U.S. Pat. No. 6,834,574, the indicia 15 enable a respective sensor 11 or 13 to discern the location of the piston rod relative to the cylinder, as well as the changing displacement of the piston rod as it is extended or retracted. Alternative types of sensor assemblies also usable for this purpose could include, for example, magnetic code type sensors or potentiometer type sensors.

The sensors 11 and 13 preferably transmit signal inputs to a time-referenced microprocessor-based controller 14, enabling the controller to sense differences in the respective movements of the hydraulic actuators A and B, including not only the differences in respective linear positions, displacements and directions of travel of each piston rod 10 and 12, but also differences in the respective speeds of each piston rod (as first derivatives of the sensed displacements relative to time), and in the respective accelerations or decelerations of each piston rod (as second derivatives of the sensed displacements relative to time). Where rotary movement of a hydraulic actuator is desired, rather than linear movement, the same basic principles can be used with rotary components.

The hydraulic circuit of FIG. 1 preferably receives pressurized hydraulic fluid from a reservoir 16 and pump 18 on a lift truck (not shown), under pressure which is limited by a relief valve 20, through a conduit 22 and a three-position flow and direction control valve 24. The valve 24 is preferably of a proportional flow control type, which can be variably regulated either manually or by a proportional type electrical linear actuator 24*a* responsive to the controller 14. The pump 18 also feeds other lift truck hydraulic components and their individual control valves (not shown) through a conduit 26. A conduit 28 returns fluid exhausted from all of the hydraulic components to the reservoir 16.

To extend both piston rods 10 and 12 from the cylinders of actuators A and B simultaneously in opposite directions, the spool of the valve 24 is shifted upwardly in FIG. 1 to provide fluid under pressure from pump 18 to conduit 30 and thus to parallel conduits 32 and 34 to feed the piston ends of the respective hydraulic actuators A and B. As the piston rods extend, fluid is simultaneously exhausted from the rod ends of the actuators A and B through conduits 36 and 38 through normally open valves 40 and 42, respectively, and thereafter through valve 24 and conduit 28 to the reservoir 16.

Conversely, shifting the spool of the valve 24 downwardly in FIG. 1 retracts the two piston rods simultaneously by directing pressurized fluid from the pump 18 through respective conduits 36 and 38 and valves 40 and 42 to the respective rod ends of the two actuators A and B, while fluid is simultaneously exhausted from their piston ends through respective conduits 32 and 34 and through the valve 24 and conduit 28 to the reservoir 16.

As an optional alternative, the hydraulic circuit of FIG. 1 could be modified to include an additional manually or electrically controlled exemplary valve 44 shown in dotted lines in FIG. 1. The optional additional valve 44 has two spool positions which affect the direction of movement of actuator B only. The upper spool position maintains the flows of hydraulic fluid to and from the actuators A and B in the same manner described above so that the two piston rods 10 and 12 move in opposite directions simultaneously. However, the lower spool position of valve 44, indicated as 44' in FIG. 1, reverses the directions of flow to and from actuator B (but not actuator A) so that piston rods 10 and 12 can both be moved simultaneously and reversibly in a common direction, rather than in opposite directions. This latter optional capability is useful when a pair of load-engaging members are required to move in the same direction simultaneously with a side shifting motion, often with an offsetting separation between them along their common direction of travel. More complex hydraulic valve circuitries which would place the actuators A and B in a hydraulic series arrangement, rather than leaving them in a hydraulic parallel arrangement as valve 44 does, have long been preferred in lift truck load handlers when a side-shifting movement with a fixed separation powered by oppositely-facing piston and cylinder assemblies is required. This is because a simple parallel hydraulic arrangement directs pressurized fluid to the piston end of one side-shifting cylinder and the rod end of the other cylinder simultaneously when they are moving in a common direction and are oppositely-facing as in FIG. 1. Such two ends are volumetrically different, thereby tending to create an automatic difference in the speeds of parallel-connected, oppositely-facing cylinders during side shifting. However, in the present case, because of the automatic movement-coordinating function of the electro-hydraulic circuitry of FIG. 1 to be explained below, the simpler parallel arrangement provided by the valve 44 is satisfactory.

Regardless of whether opening, closing or sideshifting movements are involved, the parallel hydraulic connections in FIG. 1 between the respective flows of hydraulic fluid through the hydraulic actuators A and B would normally tend to permit the respective movements of the two piston rods 10 and 12 to become uncoordinated in any of a number of unintended ways due to differences in their respective movements from unequal opposing forces, frictional resistance, hydraulic conduit flow resistance, etc. Such differences can result in a significant lack of coordination in absolute or relative positions, speeds, accelerations and/or decelerations of the piston rods of the actuators A and B.

In the exemplary system of FIG. 1, however, an electrically-controlled fluid-power valve assembly, consisting of valves 40 and 42 and the controller 14, are automatically operable to regulate the respective flows of hydraulic fluid through the respective hydraulic actuators A and B to decrease any such unintended differences in movement and thereby achieve accurate coordination of the actuators. Valves 40 and 42 are preferably electrically-controlled, variable-restriction flow control valves which, under the automatic command of controller 14, variably restrictively decrease the respective flows of fluid through the two hydraulic actuators A and B as needed, separately and nonsimultaneously, substantially in proportion to the sensed magnitude of any unintended difference in their movements. Instead of variable-restriction valves, the valves 40 and 42 could be electrically-controlled on/off valves which are preferably pulsed or dithered rapidly between their on and off positions by the controller 14 separately and nonsimultaneously at variable frequencies to variably decrease the average respective fluid flows, resulting in a restrictive flow control similar to that of a variable-restriction valve.

Although the electrically-controlled fluid-power valves 40 and 42 are preferably of a flow restricting type, as a further alternative they could be of a variable-relief type which, when actuated nonsimultaneously to regulate the flow through one or the other of the actuators A and B, variably relieve (i.e., extract) hydraulic fluid from the fluid flow to decrease the flow, and exhaust such extracted fluid to the reservoir 16 through valve 24 and conduit 28.

In any case, the valves 40 and 42 preferably operate under the automatic control of the controller 14 by virtue of respective control signals 43 and 45 as shown in FIG. 1. Regardless of whether the hydraulic actuators A and B are moving in opposite directions, or optionally moving in the same direction as discussed above, the valve 40 is capable of regulating the flow of fluid in conduit 36 reversibly through actuator A, and the valve 42 is likewise capable of regulating the flow of fluid in conduit 38 reversibly through actuator B. Thus valve 40 variably controls the movement of actuator A, and valve 42 separately and nonsimultaneously variably controls the movement of actuator B.

An exemplary algorithm for the control of the valves 40 and 42 by controller 14 to regulate the respective flows of hydraulic fluid through actuator A and actuator B will be explained with reference to the exemplary simplified logic flow diagram of FIG. 3. At the start of the rapidly repeated logic process shown in FIG. 3, the controller senses the respective starting positions of actuators A and B at step 48 from sensors 11 and 13 respectively. Also, at step 49, various controller inputs 46 in FIG. 1 enable an operator or conventional automated warehouse control system to set intended actuator parameters, such as actuator direction of movement, actuator position limits and/or relative positions, actuator speed, acceleration and/or deceleration limits, adjustable minimum error tolerances, and/or other desired variables. Then, assuming for example that the controller is set to monitor simultaneous movements of the piston rods 10 and 12 in opposite directions about an imaginary centerline, sensor 11 of actuator A enables controller 14 to sense at step 50 whether or not the position displacement magnitude for piston rod 10 of actuator A is increasing. If yes, the controller determines that the piston rods are extending and opening away from each other and, if not, that they are retracting and closing toward each other. If the piston rods are opening, the controller determines at step 52 whether the position displacement magnitude of piston rod 10 of actuator A as sensed by sensor 11 is greater than the simultaneous position displacement magnitude of piston rod 12 of actuator B as sensed by sensor 13. If yes, the controller determines that the current position of the extension movement of piston rod 12 is lagging behind the current position of the extension movement of piston rod 10. In such case the controller sets a speed limit, which was previously input at step 49, on the leading piston rod 10 of actuator A at step 54, but sets no speed limit on the lagging piston rod 12 of actuator B. At step 56 the controller determines the magnitude of the difference between the current positions of piston rods 10 and 12, and at step 58 the controller determines whether such difference is less than an adjustable minimum error tolerance previously input at step 49. If so, valve 40 is not thereby actuated by controller 14 to decrease the existing flow through actuator A.

On the other hand, if such difference in magnitude is not less than the minimum error tolerance, the controller 14 actuates the valve 40 to decrease the flow through actuator A, in relation to the size of the difference, by variably restricting the flow exhausted from the rod end of actuator A during its extension, thus retarding the extension movement of actuator A and thereby decreasing the position difference in movement between leading actuator A and lagging actuator B. Valve 42, however, is not simultaneously actuated and remains in its normal open condition. Therefore any excess pressurized flow from the pump 18 resulting from the restriction of flow through actuator A by valve 40 is automatically diverted to actuator B through conduit 34 to speed up the extension movement of the lagging actuator B to more rapidly catch up to actuator A.

Moreover, by decreasing the difference in movement between the two hydraulic actuators A and B as a result of decreasing, but not stopping, hydraulic flow through the leading actuator A, and by maintaining a maximum speed limit only on the leading actuator A and not on the lagging actuator B, the fluid power valve assembly not only enables more rapid correction of the unintended difference in movement between the two actuators A and B, but also minimizes any delay in completing their intended movements which would otherwise be caused by the correction process.

Figure 3:
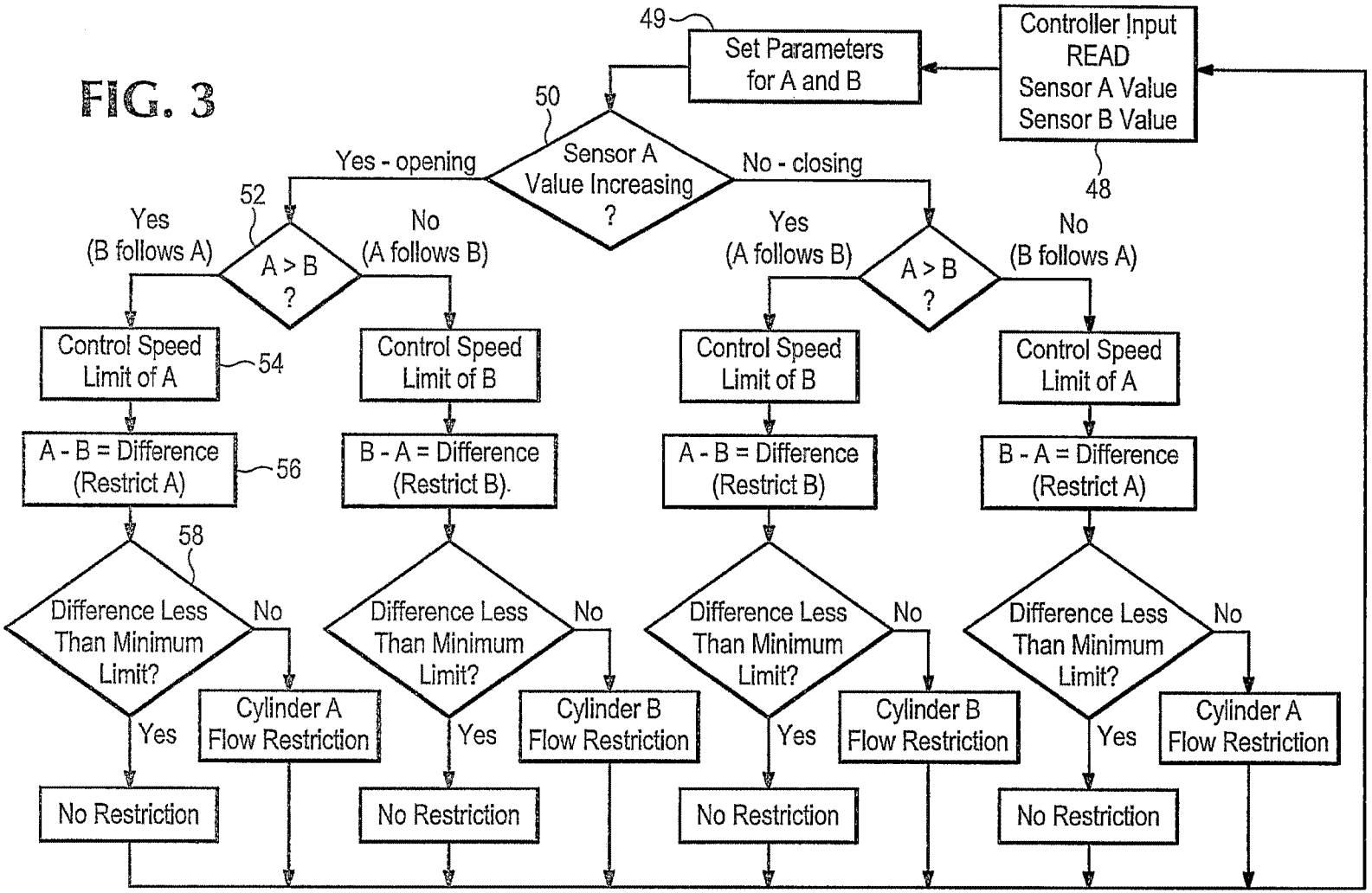
FIG. 3 is an exemplary logic flow diagram usable with the systems of FIGS. 1 and 2.

If the determination at step 52 of FIG. 3 is that actuator A, rather than actuator B, is the lagging actuator, then the same process is followed but with valve 42 being the restricting valve as shown in FIG. 3.

The logic sequence on the right-hand side of FIG. 3, relevant to the case where the actuators are both retracting in a closing manner, corresponds to the steps previously described where the actuators are both extending.

Alternatively, in the optional situation where the controller 14 is controlling movements of the piston rods 10 and 12 both in a common direction of movement as a result of having shifted the optional valve 44 to its flow-reversing position, the operation is still substantially the same as that shown in FIG. 3 where the lagging actuator is similarly determined by a comparison of the respective position magnitudes of the piston rods 10 and 12 in their common direction, excluding any intended preset separation of the rods in their common direction.

Where the difference in movement being controlled is with respect to parameters other than position, such as speed, acceleration or deceleration, the controller 14 is able to sense these differences and cause their correction through the respective valve 40 or 42, as the case may be, to decrease or eliminate the difference using substantially the same approach exemplified by FIG. 3.

The foregoing examples create asynchronous speeds of the respective actuators A and B to attain intended synchronous positions of the actuators more accurately and more rapidly than was previously possible. Conversely if it is desired to achieve similar benefits by using such asynchronous speeds to attain intended asynchronous positions of the actuators A and B, with one or more intended predetermined differences in their movements, this can be accomplished by appropriate different preset parameters for each actuator which are input to the controller at step 49 of FIG. 3. For example, if it is intended to open or close the actuators A and B so as to result in respective piston rod positions equally spaced on either side of a new centerline offset by a preset distance from an old centerline, the preset offset distance can be added to the sensed displacement of one actuator and subtracted from the sensed displacement of the other, so that the actuator having the greatest distance to move is treated as the lagging actuator in FIG. 3. A similar approach can be used, for example, if it is intended to move the actuators in a common direction to new positions having a preset separation different than their old preset separation. A similar approach can also be used if it is intended to reposition only one actuator relative to the other.

Figure 2:
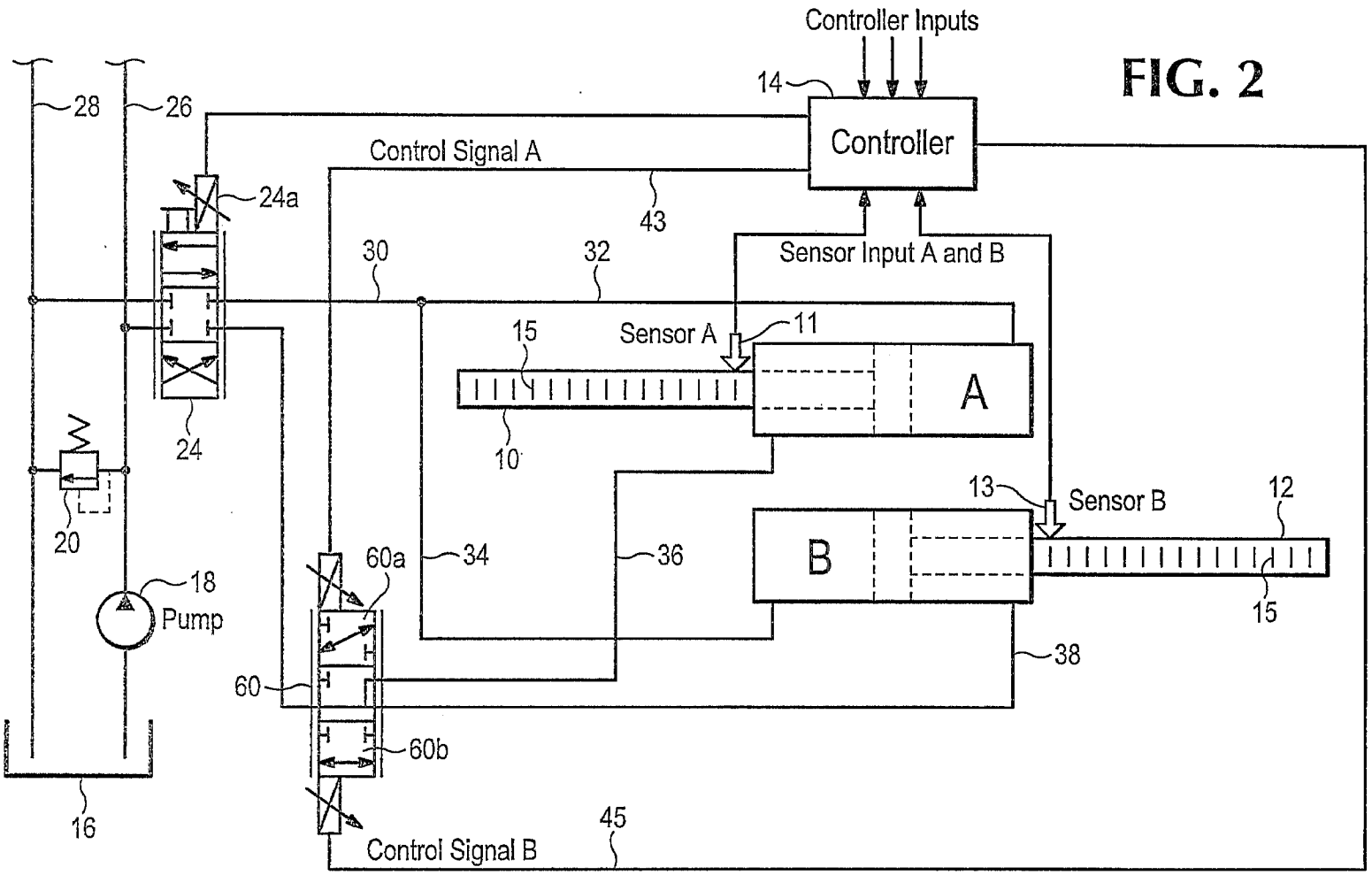
FIG. 2 is a simplified electro-hydraulic diagram of an alternative exemplary fluid power control system usable in this invention.

FIG. 2 shows an exemplary electro-hydraulic diagram substantially the same as FIG. 1, except that electrically-controlled fluid-power valves 40 and 42 are replaced by a single three position electrically-controlled proportional valve 60. The function of valve 40 of FIG. 1 is performed by the spool position 60*a* of valve 60, and the function of valve 42 of FIG. 1 is performed by the spool position 60*b* of valve 60. In accordance with the preferred mode of operation where the two valves 40 and 42 are not operated to restrict flow simultaneously, the spool positions 60*a* and 60*b* are physically incapable of simultaneous operation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A fluid power control system for regulating a respective flow of hydraulic fluid through a first hydraulic actuator and a respective flow of hydraulic fluid through a second hydraulic actuator, to enable said actuators to move respective load-engaging members simultaneously, said control system comprising:

(a) an electrically-controlled fluid-power valve assembly including a valve controller, said valve assembly being automatically operable to regulate said respective flows of hydraulic fluid so as to control movement of said first hydraulic actuator separately from movement of said second hydraulic actuator;

(b) a sensor assembly operable to enable said controller to sense a difference in movement, between said first hydraulic actuator and said second hydraulic actuator, and to generate a signal in response to said difference;

(c) said controller being operable to sense respective speeds of each of said actuators, and said electrically-controlled fluid-power valve assembly being operable to control respective maximum speed limits of said actuators in response to said respective speeds sensed by said controller;

(d) said electrically-controlled fluid-power valve assembly being operable, automatically in response to said signal and to said respective speeds of each of said actuators, to decrease said difference by controlling a maximum speed for said second hydraulic actuator while simultaneously permitting a speed higher than said maximum speed for said first hydraulic actuator.

2. The control system of claim 1 wherein said electrically-controlled fluid-power valve assembly is operable, automatically in response to said signal, to decrease said difference by decreasing said respective flow of hydraulic fluid through said second hydraulic actuator.

3. The control system of claim 1 wherein said electrically-controlled fluid-power valve assembly is operable to decrease said difference by restricting said respective flow of hydraulic fluid through said second hydraulic actuator.

4. The control system of claim 1 wherein said electrically-controlled fluid-power valve assembly is operable to decrease said difference by relieving hydraulic fluid from said respective flow of hydraulic fluid through said second hydraulic actuator.

5. The control system of claim 1 wherein said difference is a difference between respective movable positions of said actuators.

6. The control system of claim 1 wherein said difference is a difference between a predetermined desired distance separating respective movable positions of said actuators and an actual distance separating said respective movable positions of said actuators.

7. The control system of claim 1 wherein said difference is a difference between respective speeds of movement of said actuators.

8. The control system of claim 1 wherein said difference is a difference between respective time rates of change of respective speeds of movement of said actuators.

9. The control system of claim 1 wherein said movement of said first hydraulic actuator is in a direction opposite to said movement of said second hydraulic actuator.

10. The control system of claim 1 wherein said movement of said first hydraulic actuator is in a common direction with said movement of said second hydraulic actuator.

11. The control system of claim 1 wherein said movement of said first hydraulic actuator is in a common direction with said movement of said second hydraulic actuator, with respective movable positions of said actuators separated by a distance along said common direction.

12. The control system of claim 1 wherein said controller is operable to sense respective movable positions of each of said actuators, and said electrically-controlled fluid-power valve assembly is operable to control respective maximum limits of movement of said actuators in response to said respective movable positions sensed by said controller.

13. The control system of claim 1 wherein said controller is operable to compare said difference to a predetermined minimum limit of said difference, and to prevent said decrease of said difference if said difference is less than said predetermined minimum limit.

14. The control system of claim 13 wherein said controller is adjustable to vary said predetermined minimum limit.

* * * * *